US006702425B1

(12) United States Patent
Yip et al.

(10) Patent No.: US 6,702,425 B1
(45) Date of Patent: Mar. 9, 2004

(54) COALESCENCE-FREE INKJET PRINTING BY CONTROLLING DROP SPREADING ON/IN A RECEIVER

(75) Inventors: Kwok L. Yip, Webster, NY (US); Kam C. Ng, Rochester, NY (US); Dennis R. Perchak, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/252,312

(22) Filed: Sep. 23, 2002

(51) Int. Cl.[7] ..... B41J 2/15
(52) U.S. Cl. ..... 347/40; 347/16; 347/101
(58) Field of Search ..... 347/40, 9, 16, 347/101, 43, 14, 37, 41

(56) References Cited

U.S. PATENT DOCUMENTS

| | | | | |
|---|---|---|---|---|
| 3,946,398 A | | 3/1976 | Kyser et al. | |
| 4,346,387 A | | 8/1982 | Hertz | |
| 4,748,453 A | | 5/1988 | Lin et al. | |
| 4,914,451 A | | 4/1990 | Morris et al. | |
| 5,739,831 A | | 4/1998 | Nakamura et al. | |
| 5,847,721 A | * | 12/1998 | Ogata et al. | 347/9 |
| 5,880,759 A | | 3/1999 | Silverbrook | |
| 6,079,821 A | | 6/2000 | Chwalek et al. | |
| 6,343,846 B1 | | 2/2002 | Asano | |

FOREIGN PATENT DOCUMENTS

| | | |
|---|---|---|
| EP | 0 544 487 A1 | 6/1993 |
| EP | 1 215 047 A2 | 11/2001 |
| GB | 2 007 162 A | 10/1978 |

OTHER PUBLICATIONS

"Ink and Media Development for the HP PaintJet Printer", Aug. 1988, U.S. Hewlett–Packard Journal, Palmer et al, pp. 45–50.

"Impact of an Ink Drop on Paper," Asai et al, IS&T 7th International Congress on Advances in Non–Impact Printing Technologies, vol. II, p. 146, (1991).

"Study of the Impact of Drops on Solid Surfaces," Chaidron et al., IS&T 15th International Congress on Advances in Non–Impact Printing Technologies, (1999) p. 70–73.

"Impact of an Ink Drop on Paper," Journal of Imaging Science and Technology, Asai et al, vol 37, No. 2, Mar./Apr. 1993, pp. 205–207.

"Spreading and Imbibition of Liquid Droplets on Porous Surfaces" Langmuir 2002, 18, A. Clarke et al, p. 2980–2984.

"Adsorption Surface Area and Porosity," 2nd Edition, by S.J. Gregg and K. S. W. Sing, Academic Press, London, 1982, p. 173–190.

Article entitled "Automated Mercury Porosimeter" from Porous Materials, Inc., 83 Brown Road, Building 4, Ithaca, NY 14850, USA.

* cited by examiner

*Primary Examiner*—Lamson Nguyen
(74) *Attorney, Agent, or Firm*—Norman Rushefsky

(57) ABSTRACT

An inkjet printer system and method for recording an image in a single pass print mode includes a printhead having a plurality of nozzles that are selectively operable for depositing drops of liquid ink or other liquid used in forming of an image in a single pass print mode upon a surface of a receiver medium with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$. The receiver medium has a surface for receiving the drops and a region of the medium proximate the surface has an influence upon drop spreading and the region has a porosity in the range of 0.2 to 0.8 and sufficient to provide a media drop spread factor Sm wherein $Sm=D/Di$ with $2^{1/2}<Sm<2\times2^{1/2}$.

30 Claims, 7 Drawing Sheets

| PRINTING RESOLUTION | PIXEL SPACING | SAFETY FACTOR FOR Di | WETTED DOT DIAMETER | SAFETY FACTOR FOR D | FINAL DOT DIAMETER | SPREAD FACTOR DUE TO MASS TRANSPORT |
|---|---|---|---|---|---|---|
| R (dpi) | 1/R (um) | β | $D_i$ (um) | δ | D (um) | $S_m$ |
| 600 | 42.3 | 0.90 | 38.1 | 1.00 | 59.9 | 1.57 |
| 600 | 42.3 | 0.95 | 40.2 | 1.05 | 62.9 | 1.56 |
| 600 | 42.3 | 0.95 | 40.2 | 1.00 | 59.9 | 1.49 |

| SPREAD FACTOR DUE TO IMPACT Si | TOTAL SPREAD FACTOR S | αi (=Si−1) | αm (=S−Si) | REQUIRED POROSITY OF MEDIA | REQUIRED DROP DIAMETER d (um) | REQUIRED DROP VOLUME Vd (pL) | REQUIRED MASS FRACTION OF FUMED ALUMINA f2(%) |
|---|---|---|---|---|---|---|---|
| 1.48 | 2.33 | 0.48 | 0.85 | 0.26 | 25.7 | 8.9 | 46.2 |
| 1.37 | 2.14 | 0.37 | 0.77 | 0.34 | 29.4 | 13.2 | 56.7 |
| 1.26 | 1.88 | 0.26 | 0.62 | 0.42 | 31.9 | 17.0 | 67.1 |

FIG. 8

COALESCENCE-FREE INKJET PRINTING BY CONTROLLING DROP SPREADING ON/IN A RECEIVER

BACKGROUND OF THE INVENTION

1. Field of the Invention

This invention relates to inkjet printing systems and printing methods and to receivers for use therewith.

2. Description Relative to the Prior Art

Inkjet printing has become recognized as a prominent contender in the digitally controlled, electronic printing arena because, e.g., of its non-impact, low noise characteristics and system simplicity. For these reasons, inkjet printers have achieved commercial success for home and office use and other areas. Inkjet printing mechanisms can be categorized as either continuous (CIJ) or Drop-on-Demand (DOD). U.S. Pat. No. 3,946,398, which issued to Kyser et al. in 1970, discloses a DOD inkjet printer which applies a high voltage to a piezoelectric crystal, causing the crystal to bend, applying pressure on an ink reservoir and jetting drops on demand. Piezoelectric DOD printers have achieved commercial success at image resolutions greater than 720 dpi for home and office printers. Great Britain Patent No. 2,007,162, which issued to Endo et al., in 1979, discloses an electrothermal drop-on-demand ink jet printer that applies a power pulse to a heater which is in thermal contact with water based ink in an ink channel. A small quantity of ink rapidly evaporates, forming a bubble, which causes a drop of ink to be ejected from small apertures along an edge of an ink channel. This technology is known as thermal ink jet or bubble jet. Thermal ink jet printing typically requires that the heater generates an energy impulse enough to heat the ink to a temperature near 400° C. which causes a rapid formation of a bubble. U.S. Pat. No. 4,346,387, entitled METHOD AND APPARATUS FOR CONTROLLING THE ELECTRIC CHARGE ON DROPLETS AND INK JET RECORDER INCORPORATING THE SAME, issued in the name of Carl H. Hertz on Aug. 24, 1982, discloses a CIJ system. Such a system requires that the droplets produced be charged and then deflected into a gutter or onto the printing medium. U.S. Pat. No. 5,739,831, entitled ELECTRIC FIELD DRIVEN INK JET PRINTER HAVING A RESILIENT PLATE DEFORMED BY AN ELECTROSTATIC ATTRACTION FORCE BETWEEN SPACED APART ELECTRODES, issued to Haruo Nakamura on Apr. 14, 1998, discloses an electric field drive type printhead that applies an external laser light through a transparent glass substrate. The laser light strikes a photo conductive material causing it to become conductive thus completing the electrical path for the electrical field. Completion of the electrical path causes the electrical field to collapse around individual segments. These segments are in a deformed state due to their electromechanical response to the applied electric field. The individual segments in contact with a body of ink relax causing a volume of ink to issue from a nozzle plate. U.S. Pat. No. 5,880,759 entitled LIQUID INK PRINTING APPARATUS AND SYSTEM, issued in the name of Kia Silverbrook on Mar. 19, 1999; U.S. Pat. No. 6,079,821 entitled CONTINUOUS INK JET PRINTER WITH ASYMMETRIC HEATING DROP DEFLECTION issued in the names of James Chwalek, et al.; and EP1215047A2 published in the names of Anagnostopoulos et al., on the other hand, disclose liquid printing systems that afford improvements toward providing for extended length printheads better suited for page wide high-resolution inkjet printing that can be fabricated economically. As used herein, the term "page wide" refers to printheads of a minimum length of about 4" (10.2 cm). High resolution implies nozzle density, for each ink color, of a minimum of around 150 nozzles per inch to a maximum of around 6000 nozzles per inch.

One of the most damaging image defects in inkjet printing is coalescence or puddling which is observed when wet ink drops touch one another on the receiver surface. This coalescence artifact, which often occurs in high-speed printing, causes images to appear blotchy or "puddled", resulting in non-uniformity in solid fill areas. As noted by Palmer et al. in the publication entitled, "Ink and Media Development for the HP PaintJet Printer", August 1988 U.S. Hewlett-Packard Journal pages 45–50, overhead transfer film may have an image recorded thereon wherein the drops are allowed to spread by a factor of 3.5× until optimal overlap of adjacent dots is achieved. To avoid the touching of drops on the receiver surface, the maximum drop diameters shortly after the impact must be less than the pixel spacing. The dot size must then grow considerably after the drops have penetrated the surface to reach the optimum dot size. Furthermore, in Morris et al. U.S. Pat. No. 4,914,451 a method of printing is described in which ink dots are printed on a receiver medium so that the dots are a size of less than 1/R and the dots are allowed to grow to about 2.0/R. However, in the examples provided by Morris et al. post-printing image development must be provided in the form of terminating radial diffusion by solvent elimination particularly by placing the image medium between removable protective sheets. Furthermore, Morris et al. in all of their examples refer to two-pass printing and thus fail to recognize that high-speed single pass printing can be realized without coalescence of the drops.

Adamic and Gibney (European Pat. Appl. 0 544 487 A1) disclose the use of an additive (e.g., ployether polyol) in the ink to reduce the surface tension of the ink and increase the drop mass per firing. Reduced surface tension increases the wettability of ink on paper and thus enables faster ink penetration into the paper. This would alleviate the coalescence problem. However, decreasing the surface tension of ink would affect the jettability of the printhead, particularly for a piezo printhead. Furthermore, it would increase the dot size and thus reduce the print quality.

Lin et al. (U.S. Pat. No. 4,748,453) disclose a method of depositing spots of liquid ink upon selected pixel centers in a checkerboard pattern on overhead transparencies so as to prevent the flow of ink from one spot to an overlapping adjacent spot. This method uses at least two passes to complete the deposit of ink on all the pixels in a desired area. However, the use of N-pass printing, N>1 or multipass printing, would reduce the printer productivity by a factor of N.

SUMMARY OF THE INVENTION

In this invention, we describe a high-speed single pass coalescence-free inkjet printing system and method by controlling both the spreading of drops on the receiver surface and the spreading of dots within the receiver. The control of drop and dot spreading are achieved by the proper selection of drop size and the selection of receiver medium characteristics.

As used herein the term "single pass printing" refers to printing wherein ink drops are permitted to be deposited simultaneously or substantially simultaneously at adjacent pixel locations during relative movement between the printhead and the receiver medium. This is distinguished from non-single pass printing wherein predetermined patterns are established to insure that adjacent pixel locations do not have ink drops deposited simultaneously or substantially simultaneously to prevent coalescence of the drops. Thus in such non-single pass printing systems or modes a second, third or fourth pass is initiated to fill in ink drops at particular locations that were skipped during the first pass. It will be understood that the invention is directed to systems and methods that operate in a single pass printing mode and that such may be a mode of operation for high-speed operation of a particular printing apparatus which may also have the capability to operate in a multipass printing mode.

In accordance with a first aspect of the invention, there is provided An inkjet printer system for recording an image in a single pass print mode, the printer system comprising a printhead having a plurality of nozzles and selectively operable for depositing drops of liquid ink or other liquid used in forming of an image in a single pass print mode upon a surface of a receiver medium with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$; and the receiver medium having a surface for receiving the drops, a region of the medium proximate the surface having an influence upon drop spreading and the region having a porosity in the range of 0.2 to 0.8 and sufficient to provide a media drop spread factor Sm wherein Sm=D/Di with $2^{1/2}<Sm<2\times2^{1/2}$.

In accordance with a second aspect of the invention, there is provided a receiver medium or package thereof for use in an inkjet printer system wherein drops of liquid ink or other liquid used in forming of an image may be deposited upon the receiver medium in a single pass print mode with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$; and the receiver medium having a surface for receiving the drops, a region of the medium proximate the surface having an influence upon drop spreading and the region having a porosity in the range of 0.2 to 0.8 and sufficient to provide a media drop spread factor Sm wherein Sm=D/Di with $2^{1/2}<Sm<2\times2^{1/2}$, the receiver medium or package thereof including indicia associated therewith related to media drop spread factor Sm.

In accordance with a third aspect of the invention, there is provided a single pass inkjet printer comprising a printhead having a plurality of nozzles that are selectively operable for depositing drops of liquid ink or other liquid used in forming of an image in a single pass upon a surface of a receiver medium with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$; and an input for receiving a signal representing indicia associated with the medium related to media drop spread factor Sm wherein Sm=D/Di, wherein D is the final dot size on the medium after printing by the inkjet printer and Di is the dot size of a drop deposited on the receiver medium and resulting from impact with the receiver medium.

In accordance with a fourth aspect of the invention, there is provided an inkjet printing method recording an image in a single pass print mode, the method comprising providing a printhead having a plurality of nozzles and selectively operating the printhead to deposit drops of liquid ink or other liquid used in forming of an image in a single pass print mode upon a surface of a receiver medium with a printing resolution R, a dot size Di of the dots resulting from impact of the drops with the medium being in the range $0.5/R<Di<1/R$ and a final dot size D after spreading on the surface being at least $2^{1/2}/R<D<2.0/R$; and wherein the receiver medium has the surface for receiving the drops, a region of the receiver medium proximate the surface having an influence upon drop spreading and the region having a porosity in the range of 0.2 to 0.8 and sufficient to provide a media drop spread factor Sm wherein Sm=D/Di with $2^{1/2}<Sm<2\times2^{1/2}$.

In accordance with a fifth aspect of the invention, there is provided a method of inkjet printing comprising providing a printhead having a plurality of nozzles and selectively operating the printhead to deposit drops of liquid ink or other liquid used in forming of an image in a single pass upon a surface of a receiver medium with a printing resolution R, a dot size Di of the dots resulting from impact of the drops with the receiver medium being in the range of $0.5/R<Di<1/R$ and a final dot size D after spreading on the surface being in the range $2^{1/2}/R<D<2.0/R$; and providing a signal representing indicia associated with the medium related to media drop spread factor Sm wherein Sm=D/Di, wherein D is the final dot size on the medium after printing by the inkjet printer and Di is the dot size of a drop deposited on the receiver medium and resulting from impact with the medium; and in response to the signal controlling a drop size or sizes of drops emitted from the nozzles.

BRIEF DESCRIPTION OF THE DRAWINGS

The invention and its objects and further features and advantages will be apparent from the following, more particular, description considered together with the accompanying drawings, wherein:

FIG. 8 is a table showing respective drop sizes, drop spreading, and receiver examples for coalescence-free printing.

DETAILED DESCRIPTION OF THE PREFERRED EMBODIMENTS

The present description will be directed in particular to elements forming part of, or cooperating more directly with, apparatus in accordance with the present invention. It is to be understood that elements not specifically shown or described may take various forms well known to those skilled in the art.

In inkjet printing, the spreading of an ink drop into a receiver consists of two different physical processes: (1) the splaying of ink drop because of the impact effect, and (2) the mass transfer of ink drop into the receiver because of capillary action (for porous media) or molecular diffusion (for non-porous media). In general, the impact process happens in a relatively short time (~10 to 100 $\mu$sec) and provides the starting condition for the mass transfer process.

Figure 1:
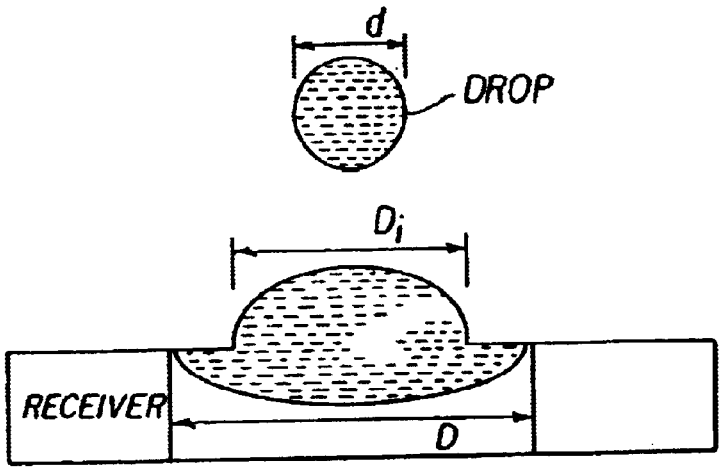
FIG. 1 is a schematic illustrating drop spreading on a receiver surface and inside the receiver in accordance with an explanation of a method and apparatus of the invention.

Thus, the total spreading for an ink drop impinging on a receiver consists of two components, namely, the spreading due to the impact effect, and the spreading due to the mass transport phenomenon within the receiver. FIG. 1 is a schematic of drop spreading on the receiver surface and inside the receiver. The total spread factor (S), which is defined by the ratio of the final dot diameter on the receiver to the initial drop diameter before impact, is simply the product of the impact spread factor ($S_i$) and the media spread factor ($S_m$), i.e., $$S=S_i \cdot S_m \tag{1}$$

While $S_i$ determines the maximum drop size on the receiver surface, $S_m$ determines the subsequent further spreading of the drop in the receiver.

1. Impact Spread Factor ($S_i$)

When an ink drop of diameter d impacts on the receiver, the drop will spread on the surface to a maximum diameter $D_i$ shortly after the impact. The impact spread factor $S_i$, which is defined by the ratio of $D_i$ to d, depends only on the Weber number (We) and the Reynolds number (Re) of the drop, independently of receiver characteristics. An empirical formula correlating $D_i$, We, and Re was given by Asai et al. in "Impact of an Ink Drop on Paper," IS&T 7$^{th}$ International Congress on Advances in Non-Impact Printing Technologies, Vol. II, p. 146, (1991).

$$S_i = \frac{D_i}{d} = 1 + 0.48We^{0.5} \cdot e^{-aWe^b/Re^c} \tag{2}$$

where $$Re = \frac{\rho d v}{\mu},\ We = \frac{\rho d v^2}{\sigma} \tag{3}$$

In Eqs. (2) and (3), a, b, and c are constants, v is the drop velocity, ρ, σ, and $\mu$ are the density, surface tension, and viscosity of the ink, respectively.

In general, the impact spread factor increases with increasing drop diameter and drop velocity but decreases with increasing surface tension and viscosity of the ink. Given the physical properties of the ink (ρ, σ, $\mu$), the impact spread factor can be controlled by varying the drop diameter and drop velocity. Based on experimental results, range of $S_i$ is between 1.26 and 4.0.

Figure 2:
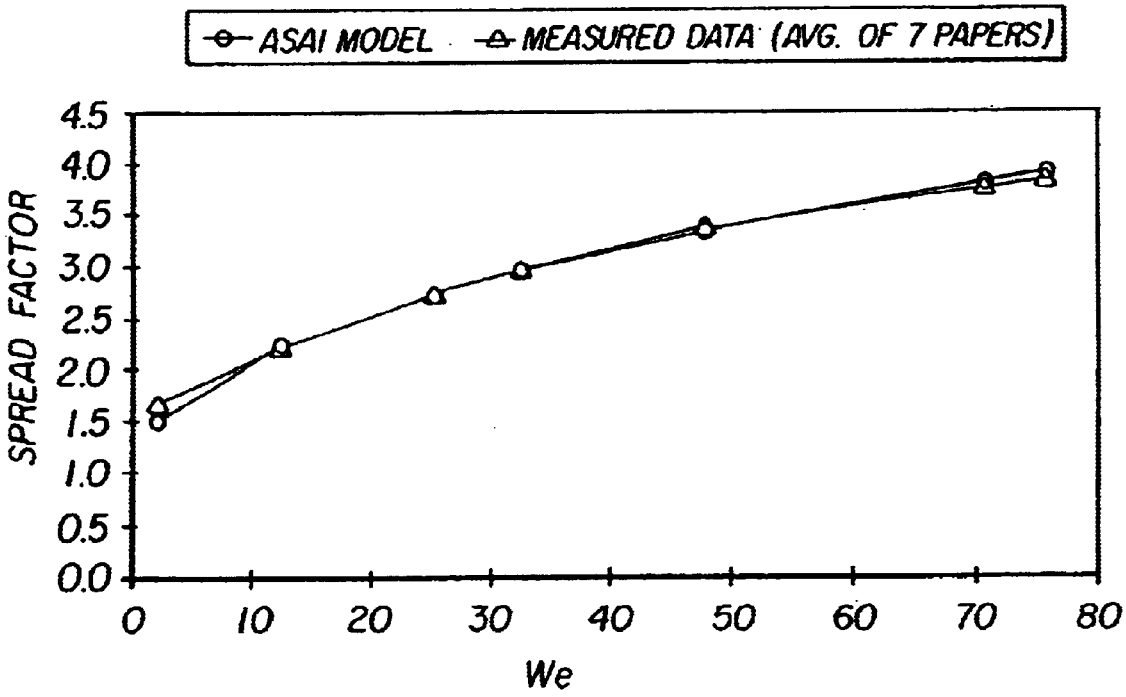
FIG. 2 are graphs illustrating the dependence of impact spread factor on the Weber number.

FIG. 2 shows the dependence of impact spread factor on the Weber number. The values of a, b, and c used in the Asai model to fit the measured data by Chaidron et al., "Study of the Impact of Drops on Solid Surfaces," IS&T 15$^{th}$ International Congress on Advances in Non-Impact Printing Technologies," p.70, (1999) are 1.48, 0.22, and 0.29, respectively. It is noted that the model results are in very good agreement with the experimental data.

2. Media Spread Factor ($S_m$)

Given the drop size, the drop velocity, and physical properties of ink, the media spread factor depends primarily on the physical properties of the media such as the porosity (for a porous medium) and the diffusion constant (for a non-porous medium). The effect of porosity on drop spreading in a porous medium has been studied by the inventors in detail using the sharp interface model. In such a model, the interface between a region of the medium that is fully saturated with liquid and a region of the medium that is fully unsaturated is considered infinitely sharp. Additionally, the capillary pressure that draws the fluid into the medium is considered constant and independent of the saturation level of the medium. Within the context of this model, the inventors calculated the maximal radial spread of the liquid as a function of the medium porosity. The total spread factor may be expressed in terms of the relative increase in radius due to impact ($\alpha_i$) and the relative increase in radius due to the ink transport in the medium ($\alpha_m$)

$$S=1+\alpha_i+\alpha_m \tag{4}$$

where $\alpha_i$ and $\alpha_m$ are related to the impact spread factor ($S_i$) and the media spread factor ($S_m$) by $$\alpha_i=S_i-1 \tag{5}$$

$$\alpha_m=S-S_i=S_i(S_m-1) \tag{6}$$

Figure 3:
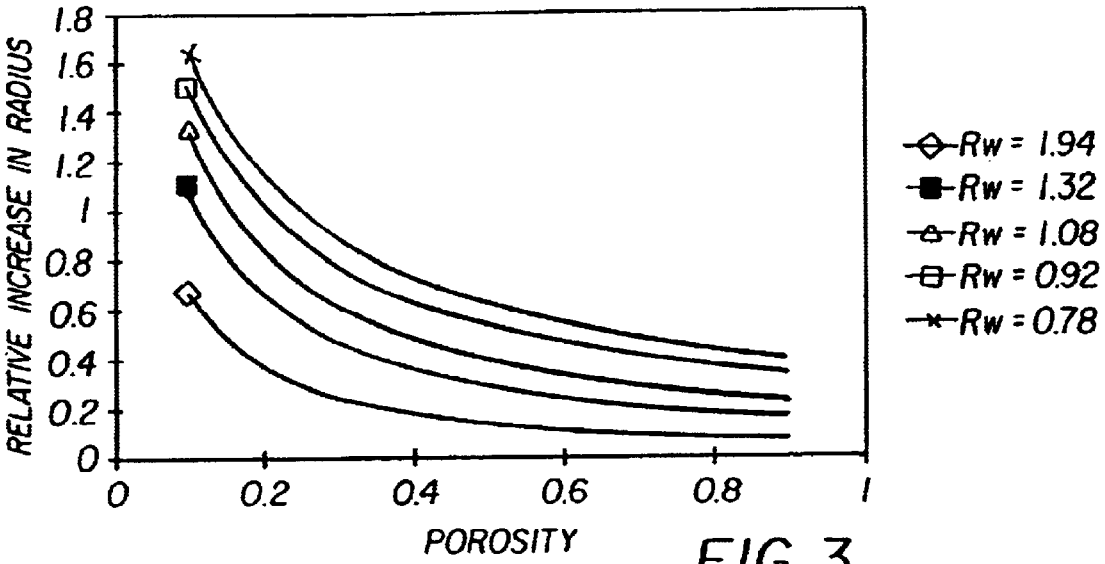
FIG. 3 are graphs illustrating the relative increase in dot radius due to the adsorption in the medium as a function of porosity for different values of the wetted radius; i.e., the drop radius after impact.
Figure 4:
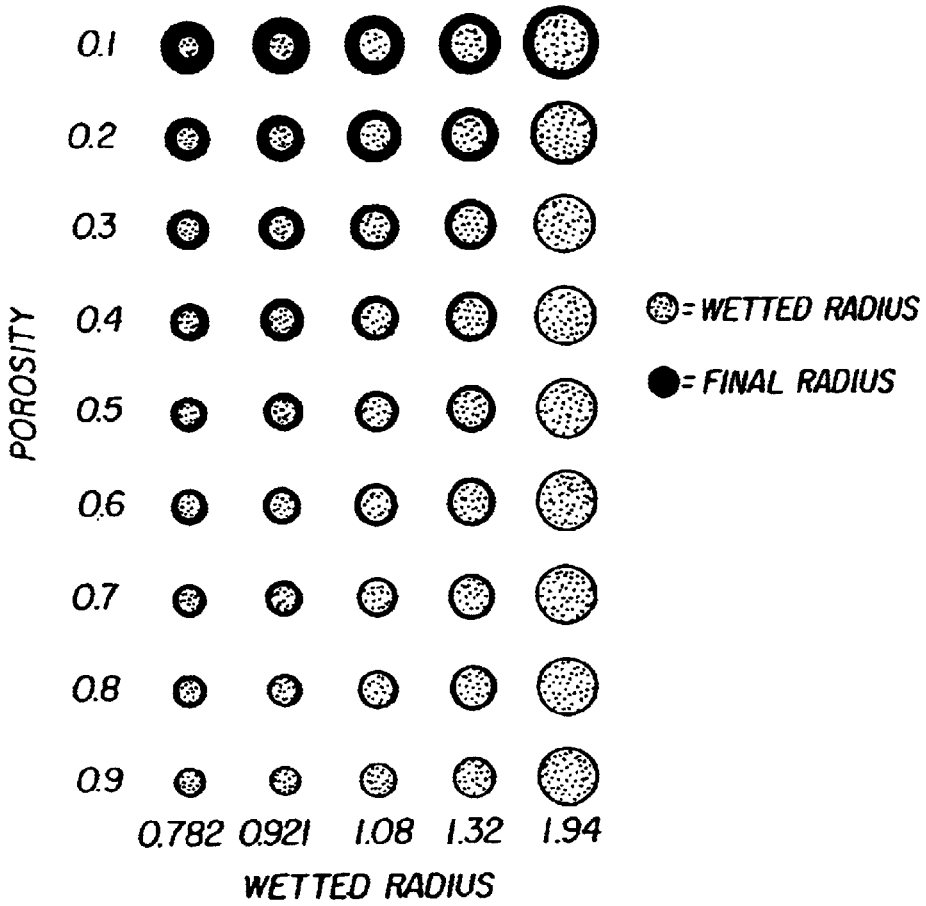
FIG. 4 is a graphic plot showing final dot size as a function of the wetted drop size on the surface and porosity of the receiver.

FIG. 3 shows the relative increase in radius due to the adsorption in the medium ($\alpha_m$) as a function of porosity for different values of the wetted radius, $R_w$ (i.e., the drop radius after impact). FIG. 4 is a graphic plot of the same data shown in FIG. 3. It is noted that at a given wetted radius the radial spread of the fluid increases as porosity is decreased. Furthermore, for a medium of given porosity the relative amount of increase in the radial spread decreases as the wetted radius on the surface is increased. In these calculations, the drop is normalized to have unit volume. So the drop radius ($R_d$) has a normalized length of 0.62. If $R_w$=0.78, we have $\alpha_i=(R_w-R_d)/R_d$=0.26 and $S_i$=1.26.

3. Dependence of Porosity of Porous Media on Coating Parameters

The dependence of porosity of porous media on coating parameters can be described by a binary mixture model where $$\varepsilon = \left(1 - \frac{W_c}{t \cdot \rho_1}\right) + \frac{W_c}{t}\left(\frac{1}{\rho_1} - \frac{1}{\rho_2}\right) f_2 \tag{7}$$

$\varepsilon$ = Porosity $W_c$ = Coating Weight $t$ = Coating Thickness $\rho_1$ = Density_of_component_1(organic)

$\rho_2$ = Density_of_component_2(inorganic)

$f_2$ = MassFraction_of_component_2(inorganic)

Results from the binary mixture model have been found to be in good agreement with measured porosity data using the mercury intrusion porosimetry technique. Furthermore, the differential change of $\epsilon$with $f_2$, the void volume ($V_{void}$) of the coating, and the differential change of $V_{void}$ with $f_2$ are given by $$\frac{d\varepsilon}{df_2} = \frac{W_c}{t}\left(\frac{1}{\rho_1} - \frac{1}{\rho_2}\right) \tag{8}$$

$$V_{void} = \varepsilon \cdot t \tag{9}$$

$$\frac{dV_{void}}{df_2} = W_c\left(\frac{1}{\rho_1} - \frac{1}{\rho_2}\right) \tag{10}$$

Figure 5:
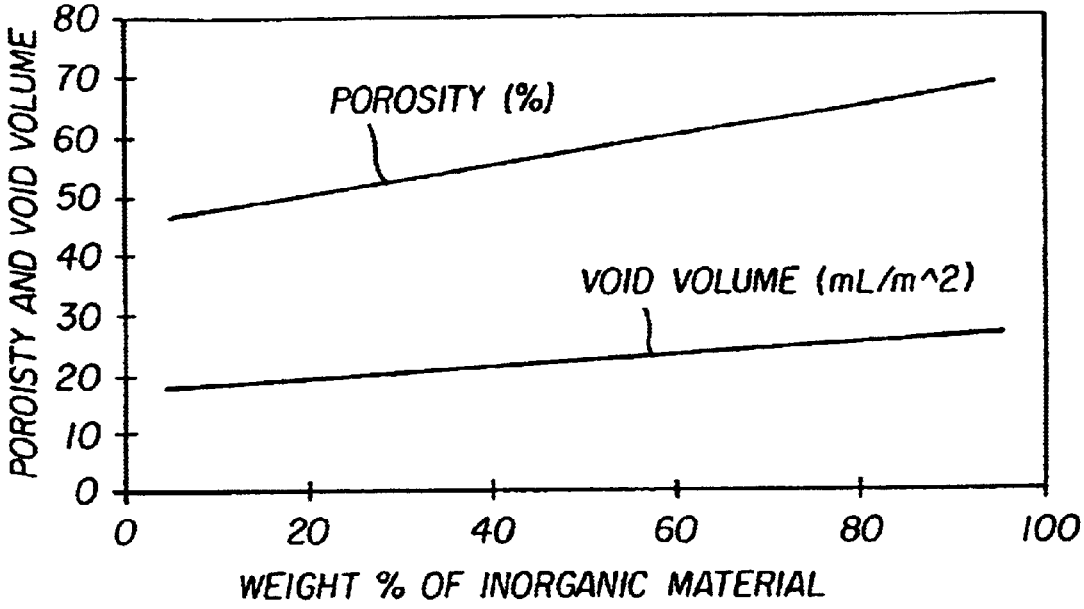
FIGS. 5 and 6 are graphs illustrating the dependence of porosity and void volume on mass fraction of inorganic material for receiver media with silica/PVA and fumed alumina/PVA coatings, respectively.
Figure 6:
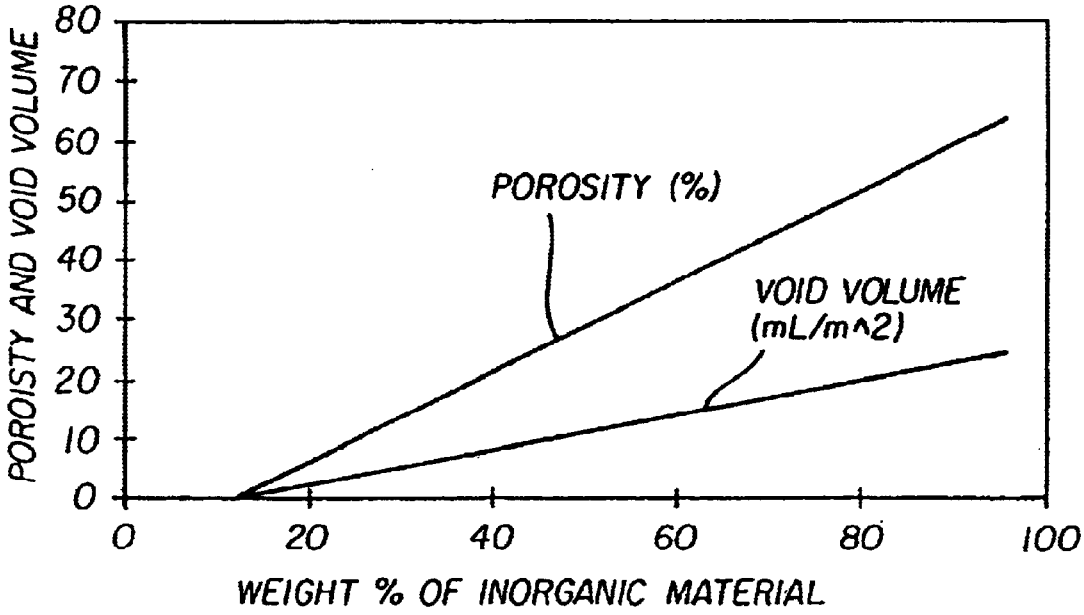

FIGS. 5 and 6 show the dependence of porosity and void volume on mass fraction of inorganic material for the silica/PVA and fumed alumina/PVA (W=hd c=25.5 g/m$^2$, t=39$\mu$m) and fumed alumina PVA ($W_c$=51.2 g/m$^2$, t=39$\mu$m) coatings, respectively. These figures indicate that both the porosity and void volume of a porous coating are a linear function of the mass fraction of the inorganic component. By the proper selection of coating weight and the weight ratio of inorganic to organic materials in the coating, the desired porosity and void volume for optimal printing can be obtained.

Figure 7:
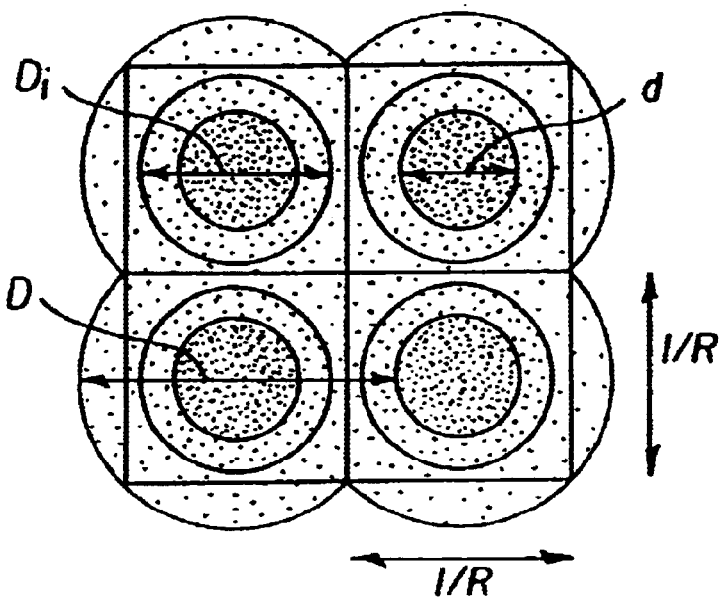
FIG. 7 is an illustration showing coalescence-free inkjet printing by controlling drop spreading on/in a receiver in a single pass printing mode in accordance with the invention.

4. Requirements on Drop Size, Drop Spreading, and Receiver Composition for Coalescence-Free Inkjet Printing To achieve coalescence-free printing, we need to avoid the touching of an ink drop with its neighboring drops on the receiver surface. Given the printing resolution (R), the drop size on the media surface after impact should be controlled to be smaller than the pixel spacing (1/R), and the final dot size at least $2^{1/2}$/R (as shown in FIG. 7), i.e., $$D_i = \beta\left(\frac{1}{R}\right), \beta < 1 \tag{11}$$

$$D = \delta\left(\frac{\sqrt{2}}{R}\right), \delta \geq 1 \tag{12}$$

For example, if $\beta$ and $\delta$ are chosen to be 0.9 and 1.0, respectively, the required media spread factor ($S_m$=D/$D_i$) should be at least 1.57.

FIG. 8 is a table showing respective drop sizes, drop spreading, and receiver examples for coalescence-free printing. As an example, let us assume that the printing resolution is 600 dpi, the safety factors $\beta$ and $\delta$ are chosen to be 0.9 and 1.0, respectively, and the impact spread factor ($S_i$) is 1.48. From the table of FIG. 8, the required drop volume, porosity, and weight percentage of fumed alumina in the binary porous coating (fumed alumina/PVA) are 8.9 pL, 0.26, and 46.2%, respectively, for achieving coalescence-free printing.

Figure 9:
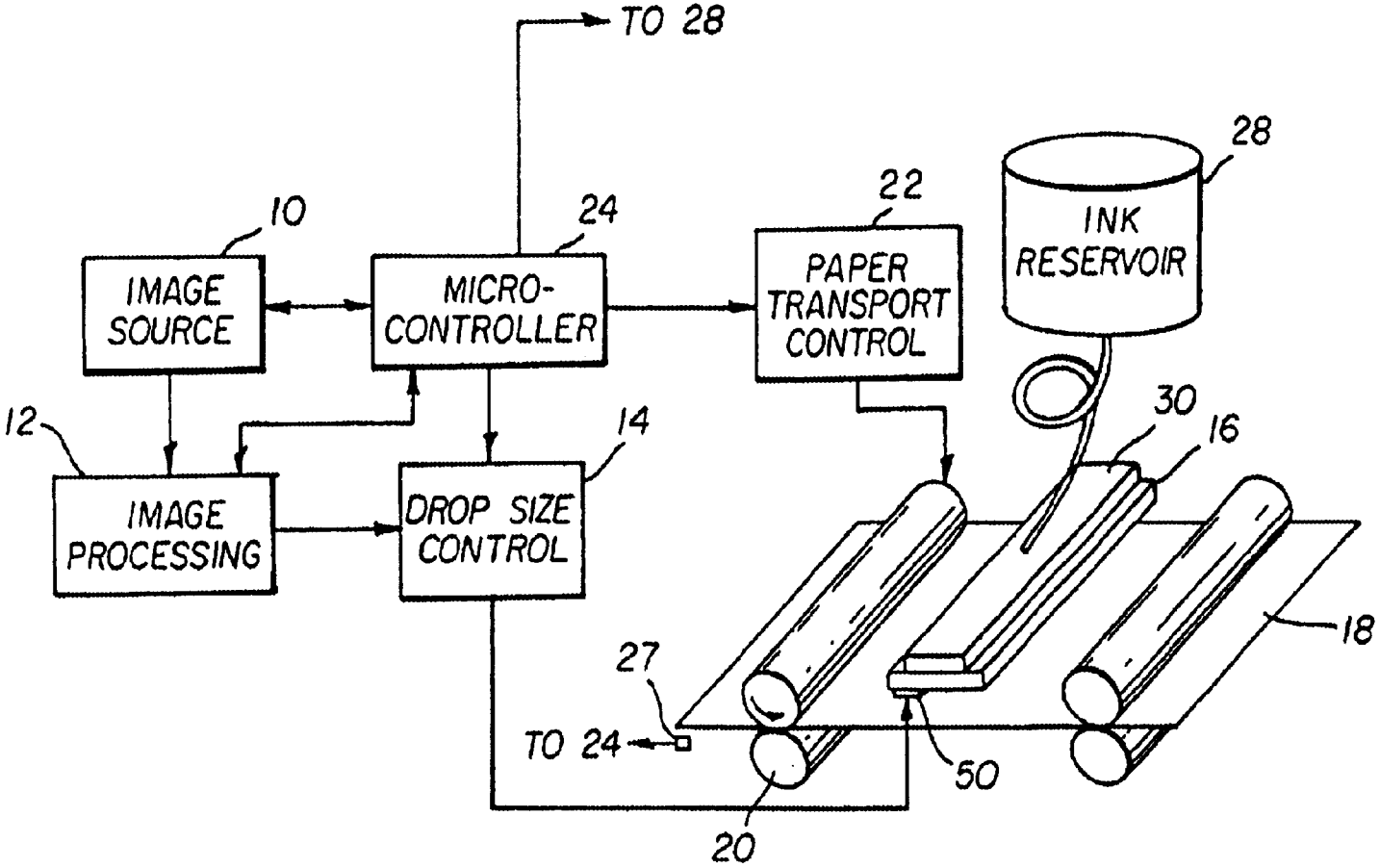
FIG. 9 is an inkjet printer system in accordance with the invention.

With reference now to the printer system of FIG. 9, an inkjet printer system includes an image source 10 such as a scanner or computer which provides raster image data, outlined image data in the form of page description language, or other forms of digital image data. This image data is converted to halftoned or other bitmapped image data by an image processing unit 12 which also stores the image data in a memory. A plurality of control circuits 14, well known in the art, are provided and which respond to data from the image memory and apply time-varying electrical pulses to circuitry on the printhead 16 associated with each of the nozzles that are also located on the printhead. As noted above the printhead may be comprised of piezoelectric actuated ink ejecting nozzles, thermal actuated ink ejecting nozzles both in a drop-on-demand inkjet printer. On the other hand, the inkjet printhead may be one known as a continuous inkjet printhead wherein droplets are created some of which are selectively directed toward the receiver medium and others are selectively trapped without contacting the receiver medium in accordance with image information to be printed. In response to image data, the control system may be one which is adapted to provide varying drop sizes depending upon the requirements of the image data to be printed. For example, the image data for each pixel to be printed may be represented by more than one bit of image data to allow for many different drop sizes, preferably forming dots Di up to less than 1/R in size for the maximum size dot in the single pass mode of printing and prior to spread due to porosity of the medium. As a further example, an image data signal of four bits per pixel bit depth may define up to 16 different drop sizes and thus pixel sizes of from 0 to 15 relative sizes. Variations in dot size at a pixel location may also be provided by depositing multiple drops in quick succession at the pixel location during a single pass to form a dot on the receiver surface having a dot size Di up to less than 1/R in size prior to spread due to porosity of the medium. On the other hand, the image data may be represented by only one bit per pixel bit depth; i.e. either a drop is deposited or not at a pixel location and all drops deposited are substantially the same size. Inkjet control circuits are known for creating these different drop sizes in accordance with the image information to be printed. The pulses are applied at an appropriate time, and to the appropriate nozzle, so that the drops formed will form dots on a recording medium 18 in the appropriate position designated by the data in the image memory.

The receiver medium 18 is moved relative to printhead 16 by recording medium transport system 20, which is electronically controlled by a receiver medium transport control system 22 and which in turn is controlled by microcontroller 24. The receiver medium transport system may take many different mechanical configurations. In the case of page wide printheads, it is most convenient to move receiver medium 18 past a stationary printhead 16. However, in the case of scanning print systems, it is usually more convenient to move the printhead along one axis (the sub-scanning direction) and the recording medium along an orthogonal axis (the main scanning direction) in a relative raster motion. As another alternative, the printhead may be a 2D printhead such as a full page size printhead for printing plural lines of images including a full page simultaneously or substantially simultaneously. It will be understood that the printhead 16 may comprise three or more rows of nozzles, each row being of a pagewidth in dimension and each printing with a different color ink with the rows of nozzles operating substantially simultaneously. Each of the rows of nozzles comprises a series of nozzles spaced from each other uniformly at a spacing of 1/R. The rows of nozzles may be spaced from adjacent rows also by a spacing of 1/R. As noted above, printing is through single pass printing wherein all of the colors for the image to be printed are printed through a single pass of the printhead relative to the receiver medium.

Ink is contained in an ink reservoir 28 which may be under pressure in some printing systems. The ink is distributed to the back surface of printhead 16 by an ink channel device 30. The ink preferably flows through slots and/or holes etched through a silicon substrate of printhead 16 to its front surface, where a plurality of nozzles are situated. With the printhead 16 fabricated from silicon, it is possible to integrate control circuits and/or other circuits with the printhead.

Figure 10:
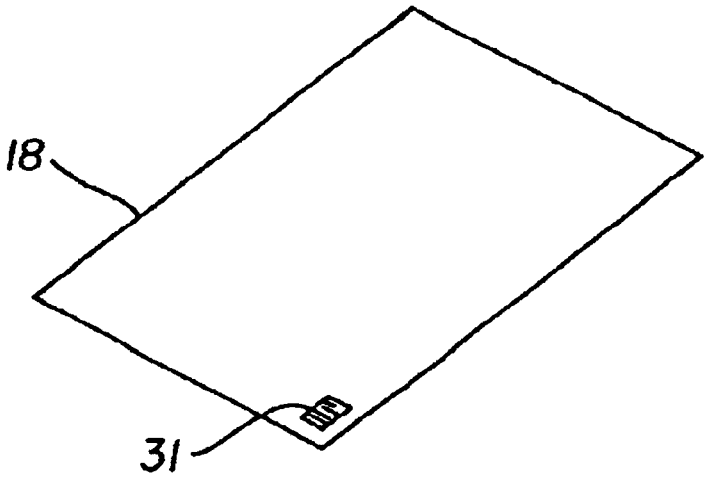
FIG. 10 is a schematic of a receiver sheet or receiver medium that includes indicia indicative of media spread factor for the receiver sheet.
Figure 11:
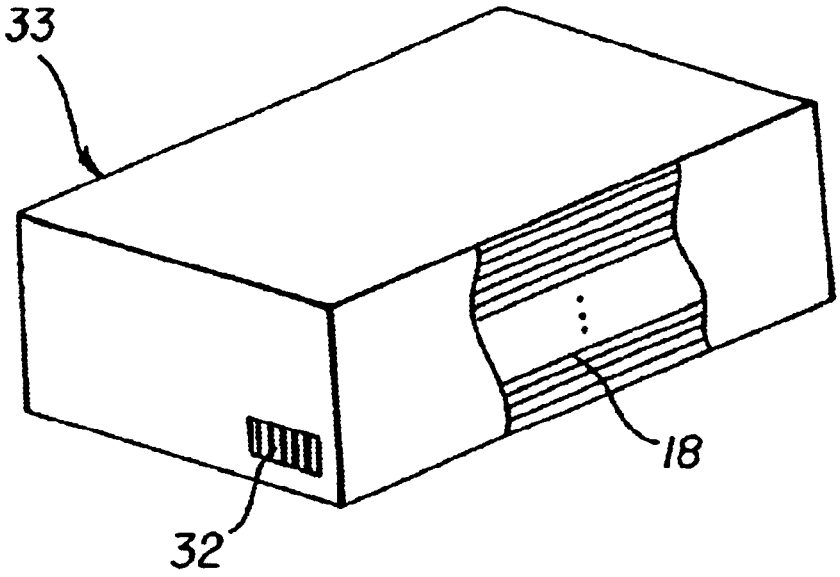
FIG. 11 is a schematic of a package of receiver sheets, wherein the packaging material includes indicia relating to the media spread factor for the receiver sheets in the package.

In accordance with one aspect of the invention microcontroller 24 is responsive to an input signal related to the media spread factor Sm for the receiver sheet being printed upon. In this regard it will be noted in accordance with an aspect of the invention that a sensor 27 detects indicia on a backside of the receiver sheet that provides information relative to the spread factor Sm of the receiver sheet. As may be noted in FIG. 10 indicia 31 may comprise a barcode or other type of printed or coated indicia and the sensor 27 may be located proximate the backside of the receiver sheet for detecting the indicia as the receiver sheet 18 enters the printing station. Alternatively, the indicia 32 may be provided on the packaging 33 of the receiver sheets, see FIG. 11, and either detected automatically by the printer or input through a keyboard, touch screen or other input control device used by the operator. The microcontroller 24 includes memory that stores tables for associating receiver media spread factor Sm with drop size or sizes appropriate for the printing on the particular medium in accordance with the invention. These tables may have stored therein different values of drop sizes in accordance with the resolution, R, of the image to be printed.

The inks and receiver media used with the invention are preferably those that provide for adsorption and spreading of the ink through a porous material wherein the spreading is through a pressure gradient and spreading substantially terminates relatively quickly even though there remains a concentration gradient of the colorant. The porous material is typically 20–40 micrometers in thickness and may or may not be coated on a substrate and may or may not contain a mordant. The thickness of the porous layer is made sufficiently thick to hold the volume of ink to be deposited therein. The concentration of dye or pigment within the carrier fluid of a drop is typically between about one percent and three percent. The support for supporting these layers may comprise paper or plastic transparency material. The receiver may also be made up of multiple layers of porous materials. As it is known to print printing plates using an inkjet printhead that deposits ink attracting or ink repelling dots, the invention also contemplates depositing such liquids on printing plates that are eventually used to selectively attract ink thereto for printing on receiver sheets.

Receiver media having a gelatinous overcoat are not suited for the invention as diffusion continues and typically is terminated by drying of the solvent carrier such as by placing the printed receiver media in a sleeve as noted in the prior art cited above. In the printing system and method of the invention placing of the printed receiver media in a blotting means such as a sleeve is not required. Instead, the invention preferably employs a receiver medium with a porous coated layer so that ink transport tends to be two to three orders of magnitude faster than in a nonporous media due to capillary forces being such that there is fast transport of the ink. The media with a porous coated layer has a structure that includes inorganic particles (such as fumed alumina and silica) in an organic binder (such as polyvinyl alcohol (PVA)) with a hardener (such as dihydroxydioxane (DHD)), that comprises the porous coated layer upon which the ink drops are deposited.

In accordance with the invention the media drop spread factor is preferably in the range of $2^{1/2}<Sm<2\times2^{1/2}$, wherein $2^{1/2}$ is the square root of 2 or 1.414, and more preferably in the range of $1.414<Sm<2.357$. A most preferred range is $1.414<Sm<1.768$.

Preferred printing resolutions are in the range of 150 DPI–6000 DPI, more preferably 300 DPI–2400 DPI, and most preferably 600 DPI–1200 DPI.

Preferred drop impact dot sizes are preferably in the range $0.5/R<Di<1/R$, more preferably $0.7/R<Di<0.9/R$, and most preferably $0.8/R<Di<0.9/R$.

Preferred ranges of final dot sizes are $2^{1/2}/R<D<2.0/R$, more preferably $1.5/R<D<1.8/R$, and most preferably $1.1\times2^{1/2}/R<D<1.7/R$.

Porosity of the layer in which the ink dots spread is preferably in the range of 0.2–0.8, more preferably in the range of 0.25–0.7, and most preferably in the range of 0.3–0.5. Porosity is determined by the ratio of the volume of the void in the layer to the total volume of the layer. The volume of the void is the interstices between the inorganic particles bound by the binder. This is a well-known definition of porosity.

In order to determine the various parameters described herein, ink drops were ejected periodically by a piezoelectric inkjet printhead so as to impinge perpendicularly upon a receiver medium. The size and the velocity of ink drops were controlled by the electric pulse applied to the printhead. The apparatus used to observe the behavior of ink drops includes a microscope, a CCD camera, a strobe light synchronized to the drive pulse, imaging optics, a translating stage for receiver medium transport, a monitor, and image acquisition hardware and software, to support both still and video rate image capture. Different stages of the spreading phenomenon were observed by changing the delay of lighting. The size of an ink drop right after the impact (Di) with the receiver medium, is measured and calibrated against a known length.

The size (d) of an ink drop before impacting the medium can be determined by weighing the added weight to a container to which a large known number of ink drops (in the millions) are fired from a print head. The ink drop is assumed to be a sphere when in free flight between the printhead and the receiver medium and has a known density. The drop size (d) can then be calculated. The final dot size (D) can be measured with a microscope by ejecting isolated single drops on the medium.

References describing procedures for measuring dot size include:

(1) A. Asai, M. Shioya, S. Hirasawa, and T. Okazaki, "Impact of an ink drop on paper," J. Imaging Sci. and Technol. 37, p.205–207, 1993.

(2) A. Clarke, T. Blake, K. Carruthers, and A. Woodward, "Spreading and imbibition of liquid droplets on porous receivers," Langmuir 18, p.2980–2984, 2002.

Porosity is referred as the "openness" of a material—the size and number of air-containing spaces within a material. Specifically, porosity is defined as the ratio of the volume of open pores to the total volume of the solid. In general, the porosity of a porous material can be measured accurately by the "Mercury Intrusion Method". Details of the method can be found in "Adsorption, Surface Area and Porosity," Second Edition, p. 173–190, by S. J. Gregg and K. S. W. Sing, Academic Press, London, 1982. The principle of measurement is as follows:

A non-wetting liquid like mercury does not fill pores in a sample spontaneously because the sample/non-wetting liquid surface free energy is greater than the sample/gas surface free energy. However, application of pressure can force a non-wetting liquid into the pores of a sample. The differential pressure required to force the non-wetting liquid into a pore is given by Washburn equation:

$$\Delta p=-2\sigma\cos\theta/r$$

where $\Delta p$=differential pressure, $\sigma$=surface tension of non-wetting liquid, $\theta$=contact angle of the non-wetting liquid on the sample, and r=pore radius.

In this technique, the pressure and volume of intruded non-wetting liquid are accurately measured. Combining these data with the surface tension, the contact angle of the liquid, and the thickness of the sample, pore radius, pore volume distribution, pore surface area, and porosity are computed.

A typical porosimeter is made by Porous Materials, Inc., 83 Brown Road, Ithaca, N.Y. 14850, Model No. AMP-200-A-1.

The inks referred to herein may be dye based inks and inks with pigments particularly where the pigments have particle sizes smaller than half the pore size of the receiver's top layer (preferably smaller than one tenth the pore size of the receiver's top layer) so the pigment particles can transport through the receiver's top layer and spread.

The surface tension and viscosity of the inks or printing liquids employed are typically related to the type of printhead; i.e. thermal, piezo electric, continuous, with variations within these categories of printhead types.

In general these inks or printing liquids have a viscosity in the range of: 1 to 8 cP and a surface tension tension in the range of: 10 to 50 dyne/cm.

Ink or printing liquid volume drop ranges may be from 0.1 pL to 128 pL. Consistent with the discussion of gray level printing described herein, ultimate drop size at a pixel location can be produced by depositing multiple drops at the pixel location.

The image receiving layer in which the drops spreads may have a thickness of between 20 and 150 microns for the porosity range of 0.2 to 0.8.

There has thus been described a novel method and printer system for coalescence-free single pass inkjet printing. This method and system makes use of the fact that coalescence is due to the touching of an ink drop with its neighboring drops on the receiver surface. To avoid drop touching, the drop size on the receiver surface after impact should be controlled to be smaller than the pixel spacing (1/R), and the final dot size should be controlled to be greater than $2^{1/2}/R$, where R is the printing resolution. The drop size on the receiver surface after impact can be controlled by the proper selection of the initial drop size before impact and the drop velocity. The drop spreading in the receiver due to mass transfer phenomena can be controlled by the proper selection of receiver properties such as the porosity for a porous medium. The porosity of a binary medium can be controlled by the proper selection of coating weight and the weight ratio of inorganic to organic materials in the coating. This new coalescence-free printing technique is independent of the printing speed and is applicable to single-pass printing without sacrificing productivity.

The invention has been described in detail with particular reference to certain preferred embodiments thereof, but it will be understood that variations and modifications can be effected within the spirit and scope of the invention.

What is claimed is:

1. An inkjet printer system for recording an image in a single pass print mode, the printer system comprising:

a printhead having a plurality of nozzles and selectively operable for depositing drops of liquid ink or other liquid used in forming of an image in a single pass print mode upon a surface of a receiver medium with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$; and the receiver medium having a surface for receiving the drops, a region of the medium proximate the surface having an influence upon drop spreading and the region having a porosity in the range of 0.2 to 0.8 and sufficient to provide a media drop spread factor Sm wherein $Sm=D/Di$ with $2^{1/2}<Sm<2\times2^{1/2}$.

2. The printer system of claim 1 and wherein the dot size Di resulting from impact with the receiver medium is greater than a drop size d of the counterpart free drop so that a drop spread factor Si associated with impact wherein $Si=Di/d$ is in the range of 1.26 to 4.0.

3. The printer system of claim 1 and wherein the printing resolution R is in the range of 150 DPI to 6000 DPI.

4. The printer system of claim 1 and wherein the printing resolution R is in the range of 300 DPI to 2400 DPI.

5. The printer system of claim 1 and wherein the printing resolution R is in the range of 600 DPI to 1200 DPI.

6. The printer system of claim 1 and wherein $1.414<Sm<2.357$.

7. The printer system of claim 1 and wherein $1.414<Sm<1.768$.

8. The printer system of claim 7 and wherein the printing resolution R is in the range of 300 DPI to 2400 DPI.

9. The printer system of claim 1 and wherein the printhead is a page wide printhead and the printhead records at least a single line of overlapping pixels on the receiver medium simultaneously.

10. The printer system of claim 9 and wherein the printhead is a two-dimensional printhead and records plural lines of overlapping pixels on the receiver medium simultaneously.

11. The printer system of claim 1 and including a control system for receiving a signal related to media drop spread factor Sm of the receiver medium and the control system is programmed to control drop size emitted from the printer in response to the signal.

12. The printer system of claim 11 and wherein a receiver medium or package thereof has indicia associated therewith related to media drop spread factor Sm.

13. For use in the printer system of claim 11, a receiver medium or package thereof having indicia associated therewith related to media drop spread factor Sm.

14. A receiver medium or package thereof for use in an inkjet printer system wherein drops of liquid ink or other liquid used in forming of an image may be deposited upon the receiver medium in a single pass print mode with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$; and the receiver medium having a surface for receiving the drops, a region of the medium proximate the surface having an influence upon drop spreading and the region having a porosity in the range of 0.2 to 0.8 and sufficient to provide a media drop spread factor Sm wherein $Sm=D/Di$ with $2^{1/2}<Sm<2\times2^{1/2}$, the receiver medium or package thereof including indicia associated therewith related to media drop spread factor Sm.

15. A single pass inkjet printer comprising:

a printhead having a plurality of nozzles that are selectively operable for depositing drops of liquid ink or other liquid used in forming of an image in a single pass upon a surface of a receiver medium with a printing resolution R, a dot size Di of the dots resulting from impact of the drops with the receiver medium being in the range of $0.5/R<Di<1/R$ and a final dot size D after spreading on the surface being in the range of $2^{1/2}/R<D<2.0/R$; and an input for receiving a signal representing indicia associated with the medium related to media drop spread factor Sm wherein Sm=D/Di, wherein D is the final dot size on the medium after printing by the inkjet printer and Di is the dot size of a drop deposited on the receiver medium and resulting from impact with the receiver medium.

16. The printer of claim 15 and including a controller that is responsive to the signal for controlling drop size.

17. An an inkjet printing method recording an image in a single pass print mode, the method comprising:

providing a printhead having a plurality of nozzles and selectively operating the printhead to deposit drops of liquid ink or other liquid used in forming of an image in a single pass print mode upon a surface of a receiver medium with a printing resolution R, a dot size Di of the dots resulting from impact of the drops with the medium being in the range $0.5/R<Di<1/R$ and a final dot size D after spreading on the surface being at least $2^{1/2}/R<D<2.0/R$; and wherein the receiver medium has the surface for receiving the drops, a region of the receiver medium proximate the surface having an influence upon drop spreading and the region having a porosity in the range of 0.2 to 0.8 and sufficient to provide a media drop spread factor Sm wherein Sm=D/Di with $2^{1/2}<Sm<2\times2^{1/2}$.

18. The method of claim 17 and wherein the dot size Di resulting from impact with the receiver medium is greater than a drop size d of the counterpart free drop so that a drop spread factor Si associated with impact wherein Si=Di/d is in the range of 1.26 to 4.0.

19. The system of claim 17 and wherein the printing resolution R is in the range of 150 DPI to 6000 DPI.

20. The system of claim 17 and wherein the printing resolution R is in the range of 300 DPI to 2400 DPI.

21. The system of claim 17 and wherein the printing resolution R is in the range of 600 DPI to 1200 DPI.

22. The method of claim 17 and wherein $1.414<Sm<2.357$.

23. The method of claim 17 and wherein $1.414<Sm<1.768$.

24. The method of claim 23 and wherein the printing resolution R is in the range of 300 DPI to 2400 DPI.

25. The method of claim 17 and wherein the printhead is a page wide printhead and the printhead records at least a single line of overlapping pixels on the receiver medium simultaneously.

26. The method of claim 25 and wherein the printhead is a two-dimensional printhead and the printhead records plural lines of overlapping pixels on the receiver medium simultaneously.

27. The method of claim 17 and wherein a control system receives a signal related to media drop spread factor Sm of the receiver medium and the control system controls drop size emitted from the printer in response to the signal.

28. The method of claim 27 and wherein a receiver medium or package thereof has indicia associated therewith related to media drop spread factor Sm and the indicia is automatically sensed to generate the signal related to media drop spread factor of the receiver medium.

29. A method of inkjet printing comprising:

providing a printhead having a plurality of nozzles and selectively operating the printhead to deposit drops of liquid ink or other liquid used in forming of an image in a single pass upon a surface of a receiver medium with a printing resolution R, a dot size Di of the dots resulting from impact of the drops with the receiver medium being in the range of $0.5/R<Di<1/R$ and a final dot size D after spreading on the surface being in the range $2^{1/2}/R<D<2.0/R$; and providing a signal representing indicia associated with the medium related to media drop spread factor Sm wherein Sm=D/Di, wherein D is the final dot size on the medium after printing by the inkjet printer and Di is the dot size of a drop deposited on the receiver medium and resulting from impact with the medium; and in response to the signal controlling a drop size or sizes of drops emitted from the nozzles.

30. The method of claim 29 and wherein the receiver medium for receiving the drops has a region thereof proximate the surface having an influence upon drop spreading and the region has a porosity in the range of 0.2 to 0.8 and sufficient to provide a media drop spread factor Sm in the range of $2^{1/2}<Sm<2\times2^{1/2}$.

* * * * *